United States Patent [19]

Powers

[11] 4,327,858

[45] May 4, 1982

[54] NON JAMMING HEAD AND MAGAZINE FOR FASTENER DRIVING TOOL

[75] Inventor: Richard E. Powers, San Marino, Calif.

[73] Assignee: Power-Line Sales, Inc., El Monte, Calif.

[21] Appl. No.: 107,022

[22] Filed: Dec. 26, 1979

[51] Int. Cl.[3] ..... B25C 5/06

[52] U.S. Cl. ..... 227/121; 227/120

[58] Field of Search ..... 227/121, 123, 130

[56] References Cited

U.S. PATENT DOCUMENTS

| | | | |
|---|---|---|---|
| 2,096,371 | 10/1937 | Cavanaga | 227/121 X |
| 3,272,417 | 9/1966 | Howard et al. | 227/123 |
| 3,578,231 | 5/1971 | Novak | 227/123 |
| 3,840,165 | 10/1974 | Howard | 227/123 X |

*Primary Examiner*—Paul A. Bell

*Attorney, Agent, or Firm*—William H. Maxwell

[57] ABSTRACT

A non jamming head for power operated fastener driving tools having a driveway extended through a nose with a driving plane offset from a magazine supply of fasteners individually delivered through the driveway by a driver blade, and characterized by a back plate comprised of a pair of parallel side members defining a fastener receiving opening devoid of any obstruction ahead of the fastener, the driver blade and fastener driveway being defined by said side members, a front cover plate and an opposing parallel face at the front of the magazine rail to guide the crown of the fastener and the driver blade, the height of the extended nose from the points of the magazine supply of fasteners to the driving plane of the head not exceeding and less than the length of the individual fasteners driven into work at the said driving plane.

5 Claims, 7 Drawing Figures

11
12
P
10
M
16
H
3
35
3
20
30

15
S
14
14
M
17
32
H
20
22
18
30
24
23
21
33
34
21
24

NON JAMMING HEAD AND MAGAZINE FOR FASTENER DRIVING TOOL

BACKGROUND

This invention is concerned with power operated tools for driving fasteners into work with the application of a single stroke, and particularly to the driving of fasteners such as nails and staples and the like. Said fasteners are driven with an explosive action that severs each individual fastener from a "stick" supply thereof fed through a magazine and into the head of the tool. Heretofore, it has been thought necessary to provide guide means in the head to guide the penetrating shanks of the fasteners, as they enter the work and until the crown of the fasteners leave the head. And, despite all precautions and ingenuity in head design, there remains the ever present probability, with prior art design, of a jamming due to imperfect fastener formation. For example, there are such fastener driving tools wherein the head is provided with a gate for access to the driveway in order to clear the often expected jams. Accordingly, it is a general object of this invention to provide a fastener guiding head which is virtually non-jamming.

Fastener guiding heads for power tools of the type under consideration have been characterized by front and back plates secured together over the feed end of a magazine to which a power operated driver blade is related by a cylinder and piston means to drive fasteners through a channel formed between said front and back plates. The front plate is essentially a flat cover that closes the channel formed coextensively between the top and bottom of the back plate. A feature of this conventional prior art head construction is the opening through the back plate, said opening being in alignment with the magazine to receive fasteners into the driveway channel where each successive fastener is sheared from the stick thereof to be simultaneously guided by the two head plates and advanced toward the work. Accordingly, prior art back plates have been provided with a guide portion below the points of the fasteners held in stick formation by the magazine, said guide portion forming an extension of the head to a driving plane substantially below the magazine, for clearance. Despite design and engineered precautions, this lower portion of the back plate retained as a guide, often becomes an obstruction to imperfect fasteners, as is evident by the repeated malfunctions wherein the points of the fasteners seek a course behind the back plate rather than through the driveway channel thereof. Needless to say, such a malfunction is destructive of the tools as it causes overstress and deformations, as well as perforations through the magazine walls. Therefore, it is an object of this invention to remove and omit the said lower guide portion of the prior art back plate without loosing the fastener guiding capability of the head.

Heretofore, there has been a transfering of individual fasteners sheared from guided engagement with the next remaining fastener of the stick supply, to guided engagement with the aforesaid lower portion of the back plate and complementary opposing portion of the front plate. In this respect, it is not uncommon that the lower guide portion of the back plate is of a height greater than the length of the fastener, in which case there is a complete severance of the fastener from the stick supply before initial entrance through the driving plane and into the work. And, it is this extended nose portion of the head which has made unobvious the advantages of the present invention as it is disclosed herein. Accordingly, it is an object of this invention to establish initial entrance of the fastener points through the driving plane and into the work prior to disengagement of the severed fastener from the next remaining fastener of the stick supply. With the present invention, the lower portion of the back plate is of reduced height not to exceed the length of the fastener and preferably substantially less than the fastener length, whereby the fastener points are guided simultaneously by means of work penetration and before removal from guided engagement with the stick supply.

The magazines of prior fastener driving tools have been provided with rails and plugs thereof confined to the magazine per se and stopping short of the driveway through which the driver blade travels. Significant also is the termination of the magazine behind and fitting the back plate above its conventional lower driveway portion that forms an obstructing bridge across the head. As stated above, it is an object to remove and/or omit this lower "bridge" portion, but without losing the guideway function so necessary in delivering the fasteners in alignment with the driveway. With the present invention, the plug and/or forward end of the magazine enters the back plate opening to replace the prior art bridge member and thereby form the back of the driveway to guide the crown of the fastener and the driver blade as well. Note that the shanks of the fasteners depend free from the stick supply until re-stabilized by penetrating into the work. Also note that the crown is guided throughout the driving operation. The front cover plate remains unchanged, but with no requirement for an access gate, since jams are now eliminated.

The concept herein disclosed is generally applicable to fasteners including tacks, nails and staples. However, it is the latter staple configuration of fastener which is particularly troublesome, since there is a tendency for the two legs or shanks thereof to be twisted or misaligned. Accordingly, the lower "bridge" portion of prior art back plates have been characterized by spaced guide rails beveled so as to redirect the points of the spaced shanks into the channel-shaped driveway. However, as stated above, this guide rail configuration of the lower "bridge" portion is not always effective, as for example when the fastener imperfection is too great and the points progress and take a malfunctioning course behind said guide rails. It is these spaced guide rails which are also removed and omitted in practicing the present invention, it being an object to reduce the back plate to its very basic requirements by eliminating entirely any obstruction ahead of the fastener as it is delivered through the driveway.

SUMMARY OF INVENTION

This invention relates to power operated fastener driving tools wherein a head is provided with an extending nose portion so as to present a nose with a driving plane offset below the magazine level. The head is characterized by a back plate having an opening through which a stick of fasteners feeds for the successive removal therefrom of individual fasteners as they are severed from the stick by a driver blade that delivers the fasteners through a driveway formed thereby. In practice, the driveway is closed by a front cover plate against which the stick supply of fasteners is continuously pressed by spring means. In accordance with this invention, the back plate is comprised of separated guide members defining the fastener receiving opening that extends unobstructably to the offset driving plane of the nose. The magazine rail is characterized by a normal end face positioned coincidental with the back plane of the driveway, thereby to guide the crown of the fastener, the head of a tack or nail, and as shown to guide the transverse crown of the staple. In practice, the front of the magazine rail is closed by a plug having said end face continued in a depending portion that extends to said driving plane. In no case does the height of said depending portion of the head and front end or plug of the magazine rail ever exceed the length of the fastener; and it is this feature that ensures penetration of the fastener points into the work while the shanks remain in guided engagement with the next remaining fastener of the stick supply. However, the crown of the fastener has continued guided engagement between the front and back walls of the driveway coextensively with the driving stroke.

The foregoing and other various objects and features of this invention will be apparent and fully understood from the following detailed description of the typical preferred form and applications thereof, throughout which description reference is made to the accompanying drawings.

Figure 1:
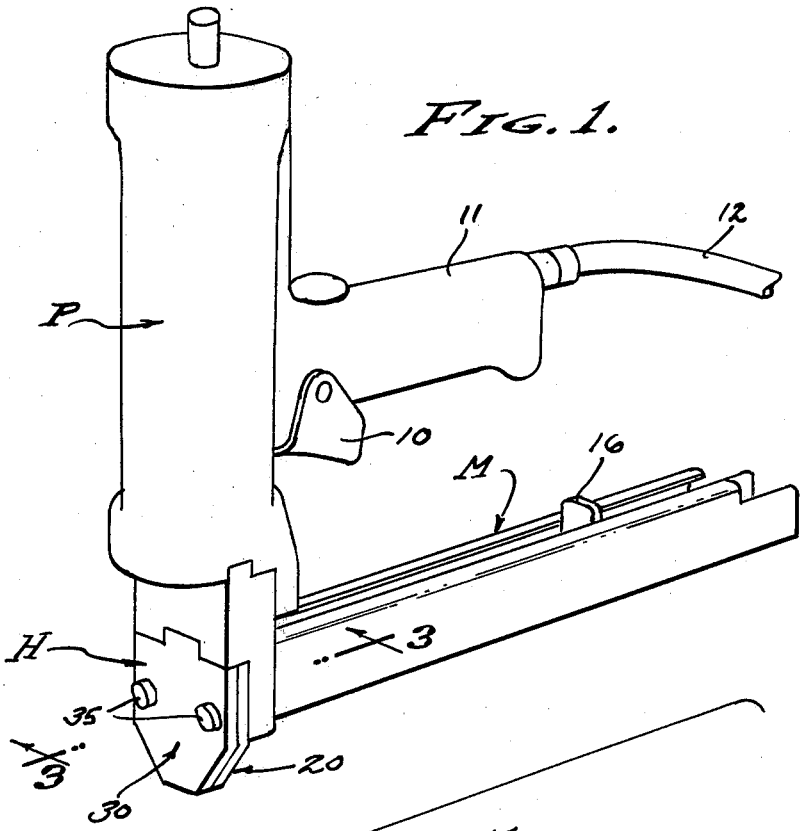
FIG. 1 is a perspective view illustrating an air operated fastener driving tool embodying the NON JAMMING HEAD of the present invention.
Figure 2:
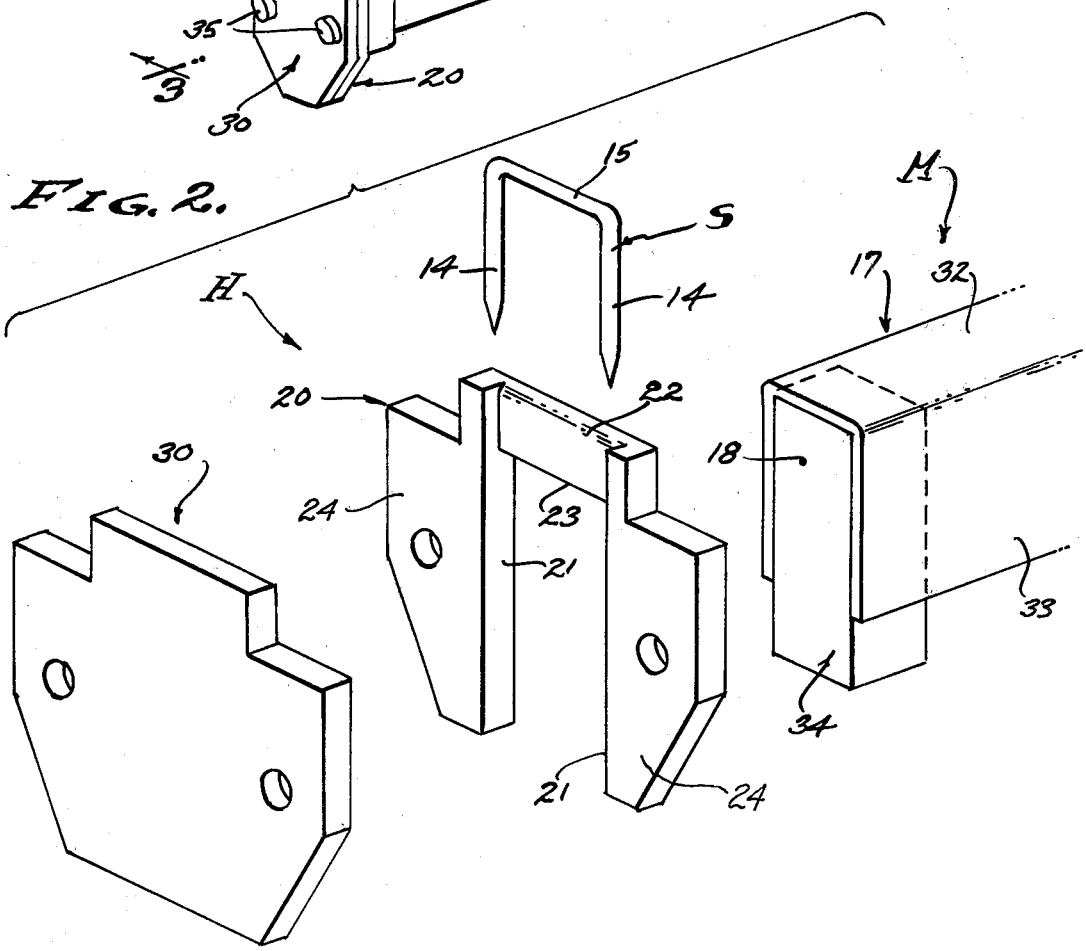
FIG. 2 is an enlarged exploded view showing the head members and fastener relationship as they appear removed from the driving tool.
Figure 3:
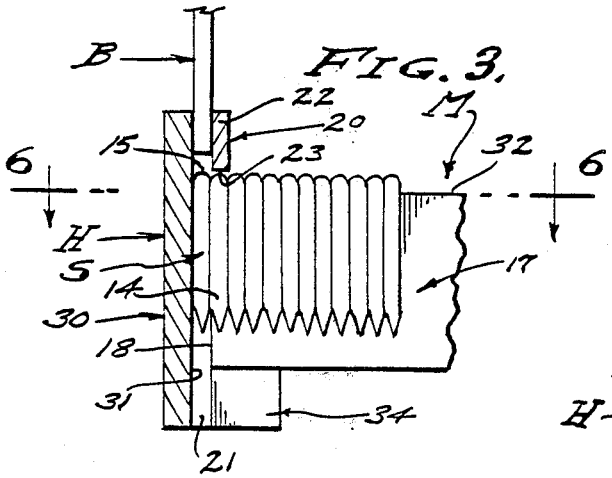
FIG. 3 is an enlarged detailed fragmentary sectional view taken as indicated by line 3—3 on FIG. 1 and showing the fastener relationship prior to operation of the driving tool.
Figure 6:
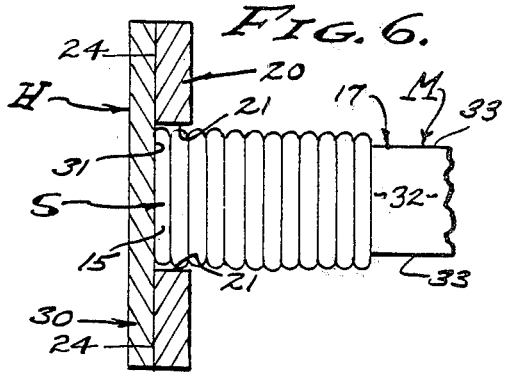
Figure 4:
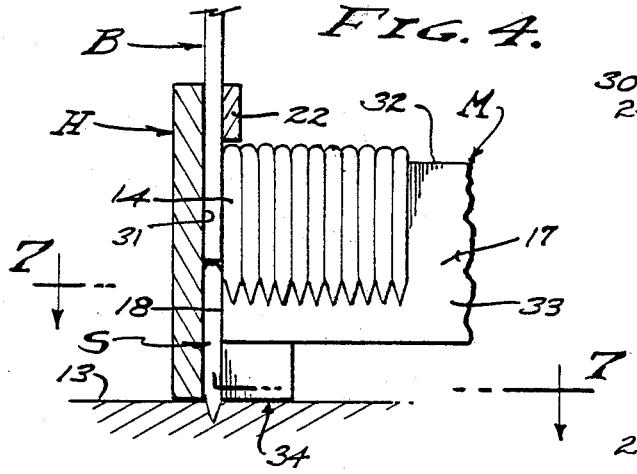
FIG. 4 is a view similar to FIG. 3 showing the fastener relationship during operation of the driving tool.
Figure 7:
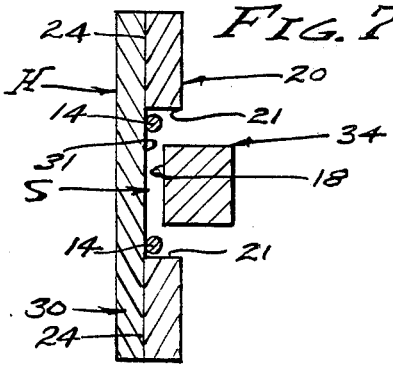
Figure 5:
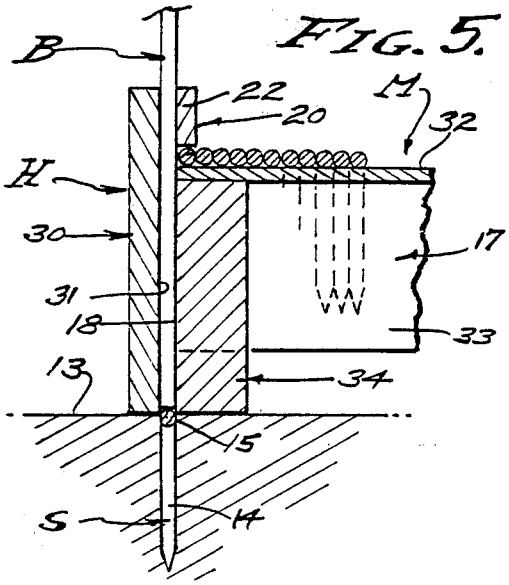

And, FIGS. 6 and 7 are sectional views taken as indicated by lines 6—6 and 7—7 on FIGS. 3 and 4 respectively.

PREFERRED EMBODIMENT

Referring now to the drawings, the power tool is shown as an air powered machine comprised of cylinder and piston means P disposed on a vertical axis and operable through a trigger 10 on a handle 11 for manual handling to reciprocate a driver blade B through a driveway constructed in accordance with this invention. Compressed air for operation of the tool is supplied through a hose 12. The piston and driver blade operate to have an explosive driving stroke downwardly into engagement with the endmost fastener or staple S of the stick thereof and continuing so as to deliver the head or crown of the fastener at the nose or driving plane 13 offset below the points of the fasteners disposed in said stick thereof. The work to be penetrated and fastened presents its surface at said driving plane 13 where the legs or shanks 14 of the fastener, a staple as disclosed in detail herein, enter into the work to be located and stabilized thereby. The head or crown 15 is driven into bearing engagement with the work at said driving plane 13. As shown, the staple S has a pair of parallel and pointed shanks 14 of equal length. The stick supply of staples S is formed by gluing a multiplicity of identical staples in columnar formation with a clear destructable adhesive that yields to the shear force applied when the driver blade strikes an individual staple to sever it from the next remaining staple of the stick.

A head H and magazine M supported thereby are carried by the cylinder and piston means P. The aforesaid driveway is incorporated in the head H for the delivery of individual staples sheared from the magazine M feeding thereto through an opening in a back plate 20, covered by a front plate 30. Characteristically, the magazine M extends normal to and rearward from the driveway plane, a substantial distance to carry a good supply of staples. A spring pressed follower 16 operates toward the head to force the stick supply forwardly into engagement with the front plate 30 which forms the front wall 31 of the driveway. The cross section of the driveway accommodates the cross section of the staple S with some clearance, and so that an individual staple S can be delivered through the driveway with each forward stroke of the driver blade B. Return means (not shown) is provided to retract the driver blade B after each stroke. The operational features and details thereof are conventional with respect to constructing the tool, with the exception of the head H and magazine M configurations and relationships, as will now be described.

Referring now to the magazine M, the staples S in stick formation are slideably carried therein with points down and with the crowns 15 supported upon a rail 17 having a front face 18 disposed in the plane of the back wall of the driveway, spaced from the front wall 31 the thickness of an individual staple (with some clearance). The rail is typically of rectangular cross section having a top 32 and sides 33 slideably engaging the crowns 15 and shanks 14 of the staples. As shown, the rail 17 is a sheet metal channel fitted with a plug member 34 at its forward end to present the front face 18 at the back wall plane of the driveway. It is this front face feature of the magazine rail that cooperates with the front plate 30 to pass the driver blade B and to guide the same and the staple crown 15 driven thereby. Note that the front face 18 of rail 17 extends from the top 32 to the driving plane 13 where the plug member 34 presents a foot engageable with the work to be penetrated and fastened.

In accordance with this invention, the back plate 20 comprises a pair of opposite side members having opposed walls 21 forming the side walls of the driveway. The opposed walls 21 are parallel and with clearance so as to slideably pass the driver blade B and staple shanks 14. In practice, the two side members of plate 20 are integrally joined by a header 22 of reduced thickness forming a guide channel for alignment of the driver blade B. This channel opens forwardly to coplanar faces 24 and is closed by the front plate 30, and its side walls are continuations of the walls 21. When retracted, the driving face of the driver blade B is disposed above the lower transverse edge 23 of the header, aligned with an individual endmost staple S.

The front plate 30 is complementary to the back plate 20 and coextensively overlies the same, with a face 31 secured to the faces 24 and to the frame of the tool by means of spaced screw fasteners 35, thereby establishing the driveway defined by the opposite side walls 21 and the opposed front and back walls 30 and 18 (front face 18 of rail 17).

In carrying out this invention the driving plane 13 is offset from the points of the staples positioned by the rail 17 a distance not to exceed the length of the staples S, whereby a guiding overlap of the shanks 14 with those of the next succeeding staples exists while penetration of the driven staple is initiated into the work to locate and stabilize the shanks for subsequent completion of the driving stroke. The shanks 14 of the severed staple S slide downward in guided engagement with walls 21 and 31, there being no obstruction whatsoever rearward of and below the points of the shanks 14. However, coextensive guiding engagement of the transverse crown 15 is provided by the front face 18 of the rail plug 34 which extends between the top 32 and driving plane 13. Accordingly, located and/or stabilized penetration of the staple S is ensured and well established before the shanks 14 leave guided engagement with the corresponding shanks 14 of the next succeeding staple which then enters into the driveway after the driver blade is retracted.

From the foregoing it will be seen that the fastener driveway has continuous front and side walls but is devoid of any rearward obstruction in alignment with the fastener shank or shanks. A feature is the extended nose of the head to a driving plane offset from the below the rearwardly extending magazine. The stick carrying rail of the magazine terminates in a face that forms an intermediate guide wall spaced from the side walls of the driveway for guiding the crowns of the fasteners being delivered to the driving plane. The extension of the nose portion of the head is substantially equal to the minimum length fastener to be driven by the tool and in no case does said extension exceed the fastener in length without sacrificing point location and adversely affecting stability afforded by initial penetration prior to complete separation of the fastener from the stick supply thereof.

Having described only a typical preferred form and application of our invention, I do not wish to be limited or restricted to the specific details herein set forth, but wish to reserve to myself any modifications or variations that may appear to those skilled in the art as set forth within the limits of the following claims.

I claim:

1. The combination of a non jamming head and magazine for a staple driving tool having a driveway extending through a nose and to a driving plane substantially offset from the magazine and through which driveway a driver blade reciprocates to sever individual staples having spaced and parallel pointed shanks and from a stick supply thereof advanced by said magazine and to deliver the same through said driving plane and into work to be fastened;

the head having a pair of spaced back members with coplanar front faces and defining a back opening extending to said driving plane and forming parallel side walls of the driveway, a front member fixed between said spaced back members and with a face engaging and coplanar with said front faces of the said pair of back members and forming a front wall of the driveway extending to said driving plane, the magazine entering the back opening and having a staple supporting rail with a front face and sides of lessor width than the spacing of the shanks of the staples leaving the back opening unobstructed behind the driven staple shanks respectively and extending to said driving plane and forming a back guide for a crown extending between the spaced shanks of the driven staple and for the driver blade moving through said back opening, and the driving plane into the work being offset from the points of the magazine supported stick of staples a height not to exceed the length of the staples, whereby penetration of a staple into the work preceeds its complete separation from the stick supply thereof.

2. The non jamming staple delivery head and magazine for a tool as set forth in claim 1, wherein said pair of spaced back members are separated to form the side walls thereof coextensively between the crowns of the magazine rail supported staples and said driving plane.

3. The non jamming staple delivery head and magazine for a tool as set forth in claim 1, wherein said pair of spaced back members are embodied in a back plate joined by a header from which they depend separately to form the said walls thereof coextensively between the crowns of the magazine rail supported staples and said driving plane, said header being disposed above the magazine means and having side wall continuations of the driveway side walls for alignment of the driver blade when retracted.

4. The non jamming staple delivery head and magazine for a tool as set forth in claim 1, wherein the front member is embodied in a plate coextensively overlying the said spaced members and closing the driveway with said face thereof.

5. The non jamming staple delivery head and magazine for a tool as set forth in claim 1, wherein said pair of spaced back members are embodied in a back plate joined by a header from which they depend separately to form the side walls thereof coextensively between the crowns of the magazine rail supported staples, said driving plane, said header being disposed above the magazine means and having side wall continuations of the driveway side walls for alignment of the driver blade when retracted, and wherein the front member is embodied in a plate coextensively overlying the said spaced members of the back plate and closing the driveway with said face thereof.

* * * * *